United States Patent [19]

Strebelle

[11] 3,945,561

[45] Mar. 23, 1976

[54] CARDBOARD CARTON

[75] Inventor: Georges Strebelle, Ronchin, France

[73] Assignee: Societe Anonyme dite: Cartonneries de la Lys "ONDULYS", France

[22] Filed: Aug. 1, 1974

[21] Appl. No.: 493,853

[30] Foreign Application Priority Data

| | | |
|---|---|---|
| Oct. 1, 1973 | France | 73.35593 |
| Feb. 6, 1974 | France | 74.4750 |

[52] U.S. Cl. ..... 229/41 B

[51] Int. Cl.[2] ..... B65D 5/36

[58] Field of Search ..... 229/41 R, 41 B, 41 C

[56] References Cited

UNITED STATES PATENTS

| | | | |
|---|---|---|---|
| 752,584 | 2/1904 | Patrick | 229/41 R |
| 756,311 | 4/1904 | Adams | 229/41 R |
| 1,088,383 | 2/1914 | Veeder | 229/41 R |
| 1,597,251 | 8/1926 | Shill | 229/41 B |
| 2,243,825 | 5/1941 | Holtkamp | 229/41 B X |
| 2,445,467 | 7/1948 | Berke | 229/41 B X |
| 2,698,709 | 1/1955 | Neuman | 229/41 B X |
| 3,251,533 | 5/1966 | Cohen | 229/41 R |

*Primary Examiner*—Davis T. Moorhead
*Attorney, Agent, or Firm*—Robert E. Burns; Emmanuel J. Lobato; Bruce L. Adams

[57] ABSTRACT

A semi-stiff cardboard carton produced, stored and transported flat until required for use, when it is set up in a single simple operation. The carton is produced from a blank having a rectangular base, side and end panels, the end panels having flaps glued to adjacent side panels. The major symmetrical axis of the blank is a first fold line and secondary fold lines extend between each apex of the base and the first fold line, the secondary fold lines lying on the interior bisector of the angle formed between edges of adjacent end and side panels. When folded, the end panels are folded in half toward the centre of the carton so that the side panels come together, and the base folds in half along the major axis and projects downwardly from the side panels.

11 Claims, 6 Drawing Figures

CARDBOARD CARTON

BACKGROUND OF THE INVENTION

The present invention relates to a semi-stiff package that can be packed flat, and also to a machine intended to produce it and pack it in a flat condition.

It is a known fact that semi-stiff packages such as cardboard boxes and cartons are normally produced folded flat so as to facilitate handling, transport and storage.

Various forms are known at the present time. The inconvenience that these various forms have in common lies in the fact that utilisation of the package necessitates a number of handling operations which may sometimes be complicated. In order that the package ready for use will keep its shape, it is necessary in some cases either to stick or staple the flaps of the package, while in other cases a specific number of folding operations must be performed in a given sequence, an operation that unnecessarily lengthens the preparation period.

None of the methods of folding at present known for packing packages flat can actually present the user with a package that can be set up quickly without complicated handling procedures.

A prime object of the invention is to remedy this inconvenience by providing a semi-stiff package that can be transported flat and which has fold lines of such kind that it can be set up ready for use without any further sticking or stapling of the flaps and without complex folding.

SUMMARY OF THE INVENTION

According to the invention there is provided a semi-stiff package capable of being packed flat in assembled form and comprising: a polygonal convex base having a maximum of four edges; lateral panels hingedly connected to said base with one panel connected to each edge of said base; at least one of the centre lines of the base forming the symmetrical axis of the whole when said lateral panels are folded down along the plane of the base; a first fold line lying along the said symmetrical axis along the base and along the lateral panels; and, between each apex of the base and said axis, a number of secondary and tertiary fold lines. The secondary fold lines advantageously extend along the interior bisectors of the angles formed between two joining edges of each two neighbouring lateral panels when the latter are folded down along the plane of the base.

Utilisation of the package is greatly facilitated as the package can be set up ready for use by simple folding carried out in a single operation.

Furthermore it is possible in this way to reduce packages of a given volume to the use of a minimum of raw card or sheet material, as it is no longer necessary to provide widely dimensioned flaps to strengthen the side panels. The proposed package is in actual fact far more economic than earlier packages produced in the form of a sheet blank and assembled by simple folding, as strengthening of the side panels in the earlier techniques necessitates the provision of double flaps.

BRIEF DESCRIPTION OF THE DRAWINGS

Embodiments of the invention will now be described by way of example, with reference to the accompanying drawings, in which.

DESCRIPTION OF PREFERRED EMBODIMENTS

The drawings relate to the production of half-boxes of substantially parallelepiped shape which, together with the possible variants described, constitute the most commonly used form of semi-stiff packages. However, as will be described below, packages may be made up in accordance with the invention in other forms.

Figure 1:
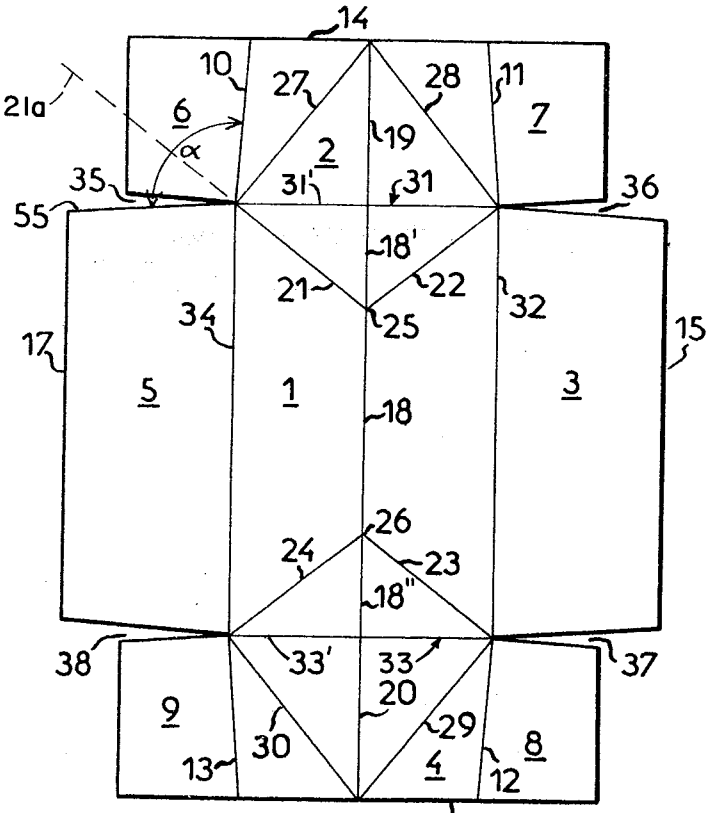

FIG. 1 shows a pre-cut sheet of bland, e.g. of cardboard or of plastic, intended to form a receptacle with a rectangular base 1.

To each side or edge 31 to 34 of the base 1, a lateral panel, 2 to 5 respectively, is hingedly attached, each of which in this case takes the form of a trapezium the longer parallel edge of which is formed by the corresponding edge of the base.

The base and the lateral panels are altogether symmetrical, in accordance with the invention, in relation to one of the centre lines of the base, preferably the longest centre line 18. The lateral panels 2 to 5 take the form of isosceles trapezia where the receptacle has a rectangular base. The interior angles of these trapezia are preferably close to being right angles for practical reasons stated below.

In the embodiment illustrated, the two end lateral panels 2 and 4 corresponding to the short edges 31 and 33 of the base 1 have along their oblique edges 10,11 and 12, 13, respectively, which are intended to enable these end panels 2 and 4 to be joined to the two other lateral side panels 3 and 5, flaps 6 to 9 intended to be stuck or fixed by any other suitable means to the panels 3 and 5 during manufacture and assembly of the receptacle.

According to a preferred means of realising the invention, the form of the flaps 6 to 9 is such that a gap 35,36,37 or 38 exists between them and the two lateral side panels 3 and 5, but not between them and the end panels 2 and 4 which bear them, when the receptacle is still in its flat sheet blank form.

The purpose of the gaps 35 to 38 is to allow the lateral side panels 3 and 5 and the flaps 6 to 9 to be disengaged and to allow the various parts to move independently during folding in order to prevent them from touching one another when the half-box is assembled, particularly where this has to be done mechanically at high speed: in fact, simultaneous accidental folding of panels 3 and 5 and flaps 6 to 9 would prevent the folding of panels 2 and 4 which bear the latter.

The flaps 6 to 9 must of course be shaped in such a way that they do not extend beyond the lateral panels 3 and 5 when they are folded onto them during assembly of the receptacle.

If required, flaps may be provided attached to the exposed edges 14 to 17 of the lateral panels 2 to 5 corresponding to upper edges of the receptacle (FIG. 3) and formed in this case by the shorter edges of the trapezia. Such flaps can form a lid completely or partly closing the receptacle (this variation is not shown on the drawing).

The new receptacle, which is shaped so that it converges towards the opening, is also intended to take a cover constructed in a way analogous to itself, except that it diverges towards its opening; this allows the cover to be fitted around or on the receptacle without having to bend the lateral panels of the latter, and therefore without any risk of the contents escaping or deteriorating and without the use of force, and the risk of catching and tearing that this would involve.

Figure 4:
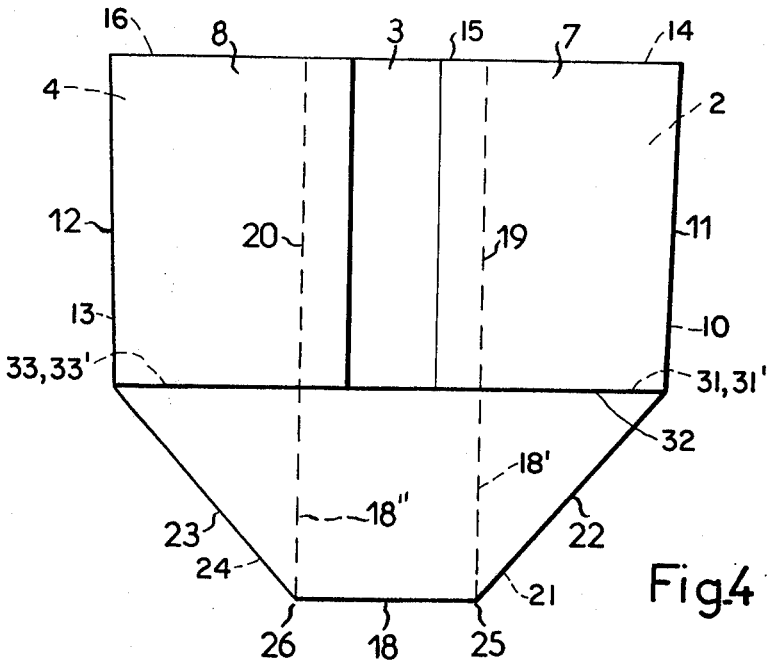
FIG. 4 is a plan view of the receptacle assembled and folded flat.
Figure 3:
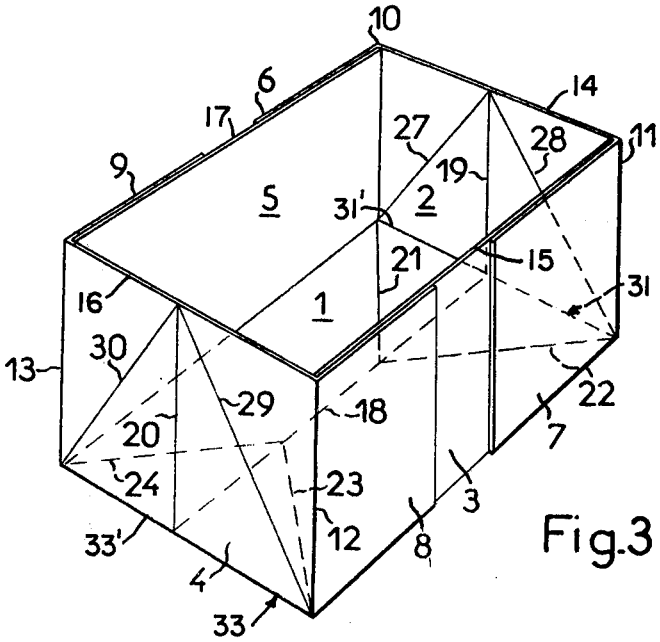
FIG. 3 is a perspective view of the assembled receptacle.

According to preferred method of realization, the angles of the various trapezia are close to 90° so as to ensure that the box shape is maintained by the mutual friction of the lateral panels of the receptacle and its cover. The lateral panels therefore are virtually rectangular in shape, as shown in FIGS. 3 and 4. This usually meets up with the optimum conditions for use and storage.

The cover intended to be fitted on the receptacle described with reference to FIG. 1 is described in relation to FIG. 2 which illustrates the sheet or blank from which it can be manufactured.

Figure 2:
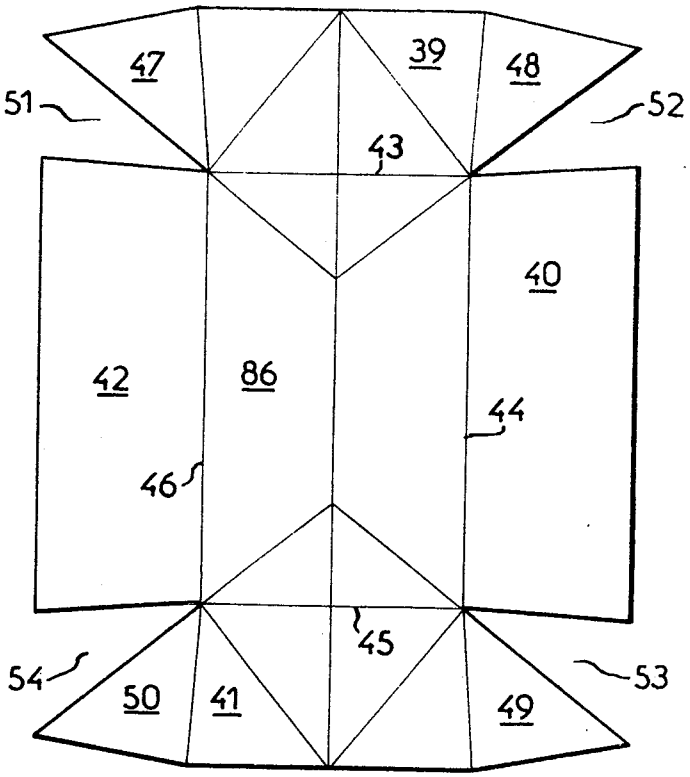
FIGS. 1 and 2 are plan views of sheets or blanks intended for the construction of two half-boxes in accordance with the invention, respectively forming a receptacle and a lid intended to cover the receptacle in box fashion.

The blank of FIG. 2 comprises, in a way analogous to the blank intended to form the receptacle, a rectangular base 86, which may be identical in size to the base 1, and four lateral panels 39 to 42 hinged to the edges 43 to 46 of the base respectively. Like the lateral panels 2 to 5, of the receptacle, the panels 39 to 42 are of trapezoidal shape, but in this case the small edge of the trapezium is hinged to the base 86.

To allow proper adjustment of the cover on the receptacle, the angles of these trapezia forming the panels intended to be superimposed, are in this case, equal.

As is the case with the receptacle, each of the small end lateral panels 39 and 41 bears along the edges that join the two other panels 40 and 42 a flap 47 to 50 intended to be fixed against one of the latter during assembly.

In this case, as in the foregoing, the sheet blank includes a disengagement gap, 51 to 54 respectively, between each flap, 47 to 50 respectively, and a panel against which it is to fit during assembly. Furthermore, the same geometrical conditions as above must be observed if the flaps are to be prevented from projecting beyond the lateral panels 40, 42 when they are fixed thereto: overall, these conditions are such that in the embodiment shown in FIG. 2 triangular flaps have been adopted.

The scope of the invention would not be exceeded, of course, if the lateral panels of the half-box were given the shape of rectangles instead of trapezoidal shape. Closure of the half-box could then be effected by means of a second analogous half-box of slightly larger dimensions, the lateral panels of which would be fitted round the lateral panels of the first.

The scope of the invention would not be exceeded if the flaps were to be provided in a different way to that described, particularly by hinging them to the large side lateral panels instead of hinging them to the small end lateral panels; provision could equally be made of a different means of joining the neighbouring lateral panels, provided that the joint obtained were sufficiently flexible to allow the package to be handled in relation to its flap packing in assembled form, i.e. when flaps 6 to 9 might, e.g. be fixed in final position to panels 3 and 5 lateral (as regards the receptacle). The handling operations being are set out below.

According to the invention, in view of the desired flat packing of the assembled package, the sheet blank includes a certain number of pre-folded lines described for present purposes with reference to FIG. 1 relating to a receptacle, it being understood that the sheet blank intended to form the cover of this receptacle FIG. 2, includes analogous fold lines.

A first fold line runs along the symmetrical axis which here constitutes the main centre line 18 of the base 1 of the blank and its extensions 19 and 20 on the two small end panels 2 and 4. As shown in FIG. 1 this fold line 18 intersects each short side or edge 31,33 of the base, dividing one half (31',33') from the other half of that side or edge.

The blank further contains a number of secondary fold lines 21 to 24 diagonally extending, between each apex or corner of the base and a point on the first fold line. As shown in FIG. 1, these diagonal fold lines are extensions of the interior bisector of angles each formed by two joining edges of two neighbouring lateral panels when the latter are folded down along the plane of the base, i.e., when the receptacle, e.g., is in its flat blank state.

In the embodiment of the receptacle illustrated in FIG. 1 these secondary fold diagonal lines are formed by four lines 21 to 24 each joining an apex of the base 1 to the centre line 18 of the latter. Diagonal lines 21 and 22, as shown, intersect the centre line 18 at a point 25 on this line 18, separated from the adjacent edge 35 of the base by a section 18' of this line 18. Similarly, the secondary, diagonal fold lines 23 and 24 intersect this center line 18 at a point 26 on the latter line, separated from the adjacent edge 33 of the base by a section 18'' of this line 18. For example, the line 21 follows the path of the interior bisector 21*a* of the angle $\alpha$ formed by the oblique edge 10 of the end panel 2 and the oblique edge 55 of the side panel 5, these edges 10 and 55 being angularly spaced apart when the sheet for the receptacle is in its flat blank state, prior to setting up the receptacle, as shown in FIG. 1. The two edges 10 and 55 are combined to become one and the same when the receptacle is assembled.

It should be noted that the larger one (18) of the two centre lines of the rectangle should preferably be chosen as the first fold line, this choice being the only way to ensure that the lines 21 and 22 do not cut across the lines 23 and 24 between their point of intersection with the axis 18 and the apex to which they are connected, which would greatly complicate folding.

The assembled receptacle or carton can be flattened or collapsed as illustrated in FIG. 3, and can be folded or set up in the form illustrated in FIG. 4. To collapse the carton the end panels 2 and 4 are respectively folded along lines 19, 18 and 20, 18'' towards the inside of the box. This operation makes the base 1 close upon itself upwards, the sections 18, 18'' 18 the first fold line 18 generally folding at a right angle, or virtually so, at intersection points 25 and 26 so as to become extensions of lines 19 and 20.

This unfolding movement and the inverse folding or collapsing movement require end panels 2 and 4 to twist. This twisting is facilitated in accordance with the invention. For this purpose the end panels 2 and 4 have tertiary or supplementary fold lines 27 to 30, connecting each apex of the base 1 to the intersection point of the first folding line with the edge, 14 and 16 respectively, of the end panels 2 and 4. These fold lines 27 to 30 localise contraints in the panels 2 and 4, forming hinges during the folding and unfolding of base and panel portions, about the several hinge and fold lines, in the collapsing and setting up of the carton.

Folding may easily be carried out by applying pressure directed upwards towards the interior of the receptacle, close to each point where the first fold line 18 intersects a short edge 31,31'; 33,33' of the base 1. Unfolding with a view to utilisation is for its part effected by applying pressure downwards on the edges 31,31'; 33,33' of the receptacle, the projecting part of the first fold line 18 of the base between points 25 and 26, being rested on a fixed suport; this unfolding is effected in a single operation in which the operator, applying pressure as described ensures that the panels separate, moving in different, opposite directions.

Setting up and maintaining the package in folded or unfolded form, these two forms corresponding to the stable state of the package, are made much easier by the fact that movement applied to the panels in order to attain either of the two forms subject these panels to torsion compensated by the elasticity of the material with which they are made. In view of such torsion, however, if the folding and unfolding operations are to be repeated without tearing, the fold lines must be only lightly marked: in practice, this is carried out by forming an impression on the sheet blank with a rounded metal profile.

The sheet blanks that have just been described may easily be folded and assembled in the form of a half-box by means of the machine that will now be described in relation to FIGS. 5 and 6.

This machine, for providing cartons according to the invention, comprises means to apply a force to the blank, against the central part of the first fold line 18, directed at right angles to its general plane and from a first face which is intended to form the interior surface of the package, towards its second face intended to form the exterior surface of the package.

In the embodiment shown, these means comprise a ram 56 the body of which is fixed in relation to a frame (not shown) and the head 57 of which presses against the first face 58 of the blank 59.

The ram 56 may, e.g., act horizontally thrusting against the face 58 of the blank 59, the latter being fed in vertically by any known insertion facility, possibly in series. The blank may be held vertically at the start of folding by a facility formed, for example, by two lateral vertical guides 60 and 61, but could also simply be suspended by grips or a band on which the blanks are pre-cut one after the other, disengaging themselves from each other when folding commences.

Preferably, a facility such as a horizontal bar 62 whose height is adjustable would allow the blank 59 to be positioned in front of the head 57 of the ram 56 in such a way that the latter would act exactly along the first fold line.

With similar effect, the head 57 of the jack takes the form of a ridge where it enters into contact with the blank, the length of this ridge being substantially equal to that of the central part of the first line, i.e. in the embodiment of FIG. 1, to the distance separating the two intersection points 25 and 26.

Figure 5:
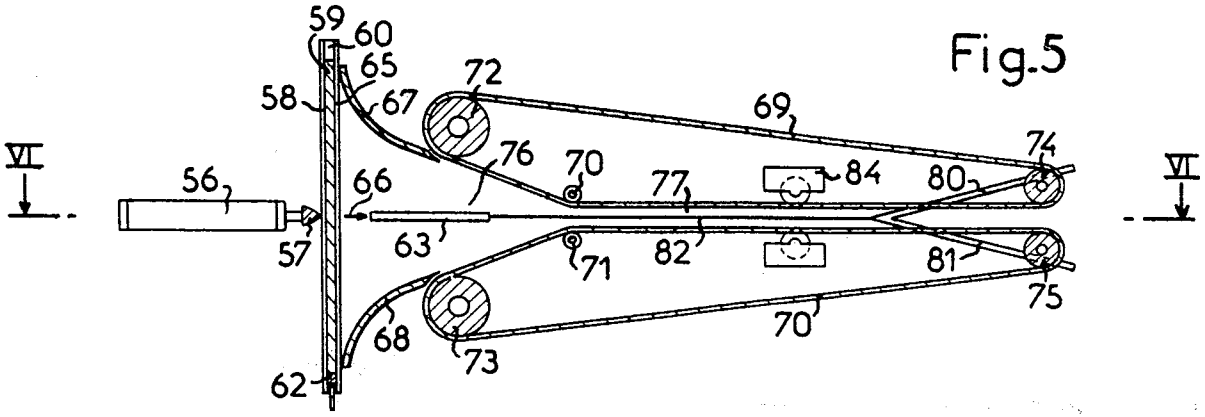
FIG. 5 is a diagrammatic view of a machine for producing packages according to the invention, in vertical axial section.
Figure 6:
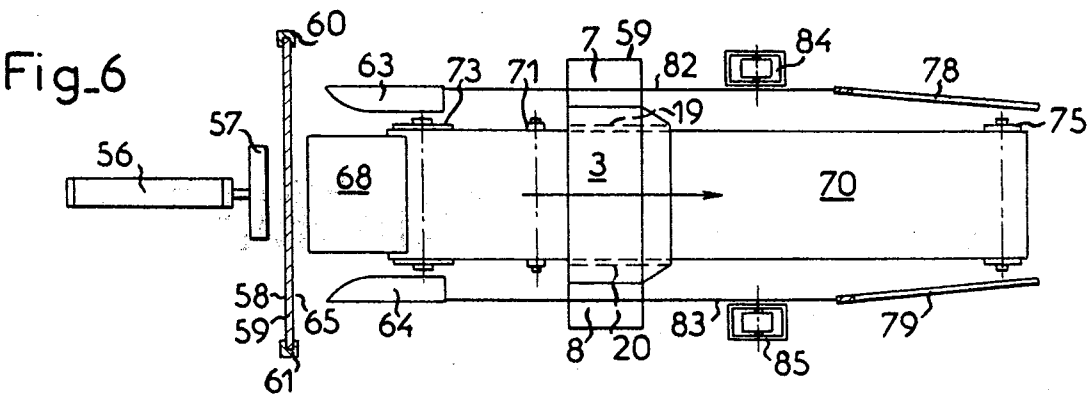
FIG. 6 is a diagrammatic view of the machine in a horizontal plane along line VI — VI of FIG. 5.

In the embodiment of the machine illustrated in FIGS. 5 and 6 the ridge of the head 57 lies horizontally, as does the first fold line of the blank 59.

The machine also comprises a first set of cams entering into contact with the blank at the end parts 18', 18'' of the first fold line 18 under the influence of the force applied, e.g. by the ram.

In the embodiment shown, the first set of cams comprises two substantially flat plates 63 and 64 lying in the same plane at right angles to the blank, alongside the second face 65 of the latter. The general plane of the two plates 63 and 64 is, in this case, horizontal and coincides with the plane formed by the ridge of the head 57 and by the direction 66 along which force is applied: consequently, when the head 57 of the ram presses on the first face 58 of the blank 59 towards the centre part of the first fold line, the two plates 63 and 64 react against the second face 65 of the blank, and equally along the first fold line.

Provided that the distance separating the plates 63, 64 exceeds the length of the centre part of the first fold line, the first fold will then be made along the central part and an inverse fold along the end parts of this central line, by folding of the base 1 along the two lines.

In the case of the receptacle illustrated in FIG. 1, the two small end panels 2 and 4 therefore fold along their central line 19 and 20 respectively so as to close in upon themselves and to be interposed between the two large side panels 3 and 5, which are superimposed in the course of this folding by the closure of the base 1 in upon itself about the central part 25–26 of the first fold line 18–19–20. The folding of the two panels 2 and 4 takes place in relation to the base along the two pairs of fold lines 21–22 and 23–24, the parts of 18' and 18'' of the first fold line lying respectively between point 25 and edge 31 of the base and between point 26 and edge 33 of the base respectively falling within the extension of lines 19 and 20.

Preferably, so as to avoid the blank tearing along the end parts of the first fold line, each of the plates 63 and 64 includes a rounded portion, directed towards the sheet and the other plate, of such a form that the rounded portions of the two plates form a space converging in the direction 66 in which the force is applied, the size of this space being at its smallest at least equal to the length of the central part of the first fold line.

Facilities may of course be provided to adjust plates 63 and 64 outwards so as to allow the same machine to be used to fold blanks of different dimensions.

According to a preferred embodiment, the machine according to the invention also comprises means to guide the blank at least while it is being folded.

These means are in this embodiment constituted by a second set of two cam plates 67 and 68 lying on either side of the general plane of the first set of cams, substantially at right angles to the space separating the latter, and forming a space between them converging in the direction 66 of the force applied by the head of the ram.

Each of the plates 67, 68 takes the form, e.g., of a plate offering, towards the blank and towards the other plate of the same set, a supporting surface for one of the large side panels 3 and 5 of the blank being folded. Where the base 1 is rectangular, the two supporting surfaces of the plates 67 and 68 are produced by two parallel lines lying diagonally in relation to the direction in which the force is applied.

Preferably, the machine according to the invention also comprises means to move the folded blank in the direction 66 to which the force is applied when the ram 56 has reached its maximum extent and when folding has reached a sufficient stage, so as to be completed by pressing on the face 65 of the folded blank without the application of internal pressure, i.e., without any pressure having to be put on the first face 58, along the central part of the first fold line.

In the embodiment shown, these means for transporting the folded blank comprise two moving belts 69 and 70 placed so as to face each other, at each side of the general plane of the plates 63, 64 of the first set of cams, the mutually facing parts of these two belts moving in the direction 66 in which force is applied. These two moving belts are situated beyond the plates 67 and 68 of the second set of cams, the mutually facing parts of these belts each extending the supporting surface of one of these cams: in the illustrated embodiment a support roller 71, 71*a* respectively, is inserted between the leading roller 72 and 73 respectively, and the trailing roller, 74 and 74 respectively, of each of the belts 69 and 70 in such a way as to divide these into two zones: an upper, converging zone 76, extending the coverging space formed by the plates 67 and 68, and a lower zone 77, in which the space between the two belts is constant and corresponds substantially to the thickness of the folded blank, i.e., in this case approximately to four times the thickness of the sheet of material forming the blank.

The two belts 69 and 70 may be moved by any known means and fitted with any facility for synchronization and for adjusting tension. Further, provision may be made for replacing them with another transporting facility taking hold of the folded blank upon its exit from the cam plates, e.g., by a set of bands or roller trains.

In the embodiment illustrated, where the package to be manufactured includes at least a base and lateral panels joined in one piece with the base, the machine according to the invention preferably includes means to set up the lateral panels of the folded package.

If the package for this purpose includes flaps hinged to the lateral panels along the edge where these join a neighbouring lateral panel, these means may for example include two guides set on either side of the moving belt, beyond the first set of cam plates, each of these guides being located along the path of the flaps which project beyond the belt, and the shape of these guides is such that movement of the folded blank causes these flaps to bend over.

Where a blank analogous to that illustrated in FIG. 1 is folded, each flap 6 to 9 lies, while folding is being undertaken by two sets of cam plates, along the extension of the lateral panel 2 or 4 to which it is attached: consequently, when the blank is engaged between the two belts 69 and 70, the two flaps 6 and 7 are superimposed, as are the two flaps 8 and 9.

As the width of the two belts is selected so that the two sets of two superimposed flaps are always on the inside of these belts whatever may be the dimensions of the blank being folded, bending over the flaps towards the large lateral panel on which they have to be fixed is effected by moving the two superimposed flaps apart by means of two guides 78 and 79 each in this case being formed by two shanks such as 80 and 81, in the case of the guide 78, these two shanks having a common end substantially in the general plane of the cam plates of the first set of cams and forming a whole, diverging symmetrically in relation to this plane. The two shanks each forming a guide may then converge the one towards the other so as to cause each flap to be applied against the large lateral panel 3 or 5 on which it has to be fixed (this operation is not shown here, the superposing and fixing of the flaps on the large lateral panels being carried out, e.g., by hand.)

In order to facilitate the engagement of each guide between the flaps to be parted, the leading end of each set of the two shanks, which is their common end, is attached to the trailing end of the cam plate of the first set situated on the same side of the belts, e.g., by a wire ensuring continuity between these elements: for example, a wire 82 attaches the plate 63 to the common leading end of the shanks 80 and 81 forming the guide 78, this wire 82 ensuring the existence and continuity of an element between the two flaps 6 and 7 of the blank; a similar wire 83 ensures continuity between the second plate 64 of the first set and the leading end of the second guide 79.

In the preferred instance of these flaps 6–9 having to be fixed by sticking them to the lateral panels 3 and 5, the machine may, downstream of the plates of the first set, include a gluing facility placed in the path of the flaps or of the said lateral panels.

In the embodiment, where the folded blank is guided by two moving belts, gluing of the flaps is more practical to effect and between each cam plate of the first set and the corresponding guide shanks, a gluing facility has been shown in FIGS. 5 and 6, constituted by two sets, 84 and 85 respectively, of two rollers rotating about a horizontal shaft fitted crosswise in relation to the direction 66; each of these rollers dipping into a bath of gum and lying in contact with one of the flaps, the two rollers of a set being situated on either side of the flaps, which are still superimposed at this state.

In this way, the flaps are first glued, then bent about their respective fold line to the small lateral panel to which they are attached, being finally bent over to their superimposed position on the large lateral panels to which they have to be fixed either by hand or by means of the guides 78 and 79, the shape of which can easily be determined by an experienced operator.

As stated above, the invention is not limited purely to substantially parallelepiped packaging with trapezoidal rectangular faces.

Flat packing in assembled form can also be undertaken of packaging whose base and lateral panels are in the form of a rectangle, or of a square, or of an isoceles trapezium, or packaging whose base is in the shape of an isoceles triangle, the first fold line being in this case formed by the length forming the median, the secondary fold lines being two in number and lying along the base of the triangle.

I claim:

1. A blank for a collapsible carton, comprising a sheet of carton material, said sheet having;

a plurality of panel members constituting outer parts of the sheet;

a convex-polygonal base member constituting a central part of the sheet;

a system of hinge lines, each defining a side of one of the panel members and a side of the base member coincident with the panel side, to enable turning the panel members about the hinge lines for setting up a carton; and a system of fold lines extending over surfaces of said base member and of several of said panel members, said system including (a) a primary fold line coinciding with a center line of the sheet, (b) a number of secondary fold lines extending into the base member, one between each corner of the base member and a point on the first fold line diagonally spaced from the respective corner, and (c) a similar number of tertiary fold lines diagonally extending across panel members, each connecting as intersection of the first fold line and of one outer edge with an adjacent corner of the base, to enable repeated twisting of the members over which the fold lines extend, relative to the fold lines, with localization of resulting constraints in the fold lines, for collapsing the set-up carton into a flat sheet unit and for unfolding said unit to again set up the carton.

2. A blank according to claim 1 in which the secondary fold lines are extensions of interior bisectors of angles, each defined by mutually converging edges of two of the panel members.

3. A blank according to claim 1 additionally including a second generally similar sheet of carton material disposed to be set up as a cover for said carton.

4. A blank according to claim 3 in which the base members of both sheets are rectangular and generally identical with one another, the panel members of both sheets being isoceles trapezoids, those of the carton having their major base lines coinciding with the hinge lines and those of the cover having their minor base lines coinciding with the hinge lines.

5. A collapsible carton, comprising;

a plurality of panel members constituting walls of a carton; and a convex-polygonal base member extending between substantially coplanar edges of said panel members; said panel and base members having a system of hinge lines, each defining one of said edges of the panel members and a side of the base member coincident therewith, to enable turning the panel members about the hinge lines for setting up the carton; and a system of fold lines extending over surfaces of such members to enable repeated twisting of the respective members relative to the fold lines with localization of resulting constraints in the fold lines, for collapsing the carton into a flat sheet unit and for unfolding said unit to reconstitute the carton, said system of fold lines including (a) a primary fold line coinciding with a center line of the base member, (b) a number of secondary fold lines extending into the base member, one between each corner of the base member and a point on the first fold line diagonally spaced from the respective corner, and (c) a similar number of tertiary fold lines diagonally extending across panel members, each connecting an intersection of the first fold line and of one outer edge with an adjacent corner of the base.

6. A carton according to claim 5 in which said base member extends between lower ones of the coplanar edges of the panel members to provide a bottom of the carton.

7. A carton according to claim 5 in which said base member extends between upper ones of the coplanar edges of the panel members to provide a top member of the carton.

8. A carton according to claim 5 in which said plurality of panel members comprises four such members, said base member being rectangular and said panel members being trapezia.

9. A carton according to claim 8 in which the hinge lines define major base lines of the trapezia.

10. A carton according to claim 8 in which the trapezia have interior angles of nearly 90°.

11. A flat sheet unit which can be converted into a carton and, before such conversion, stored as part of a pack of carton sheet units, comprising;

a plurality of interconnected, folded panel members having surfaces in contact with one another, said members being unfoldable to provide walls of a carton;

a convex-polygonal member having folded surface portions in contact with one another and unfoldable to provide a base of said carton; said members having a system of hinge lines, each defining a side of one of the panel members and a side of the convex-polygonal member coincident therewith, to enable turning the panel members about the hinge lines for setting up the carton; and a system of fold lines extending over surfaces of such members to enable repeated twisting of the respective members relative to the fold lines with localization of resulting constraints in the fold lines, for unfolding said members to set up the carton and for collapsing the set-up to reconstitute a flat sheet unit, said system of fold lines including (a) a primary fold line a part of which coincides with a center line of the base member, (b) a number of secondary fold lines extending into the base member, one between each corner of the base member and a point on the first fold line diagonally spaced from the respective corner, and (c) a similar number of tertiary fold lines diagonally extending across panel members, each connecting an intersection of the first fold line and of one outer edge with an adjacent corner of the base.

* * * * *